US009122194B2

(12) United States Patent
Shimizu et al.

(10) Patent No.: US 9,122,194 B2
(45) Date of Patent: Sep. 1, 2015

(54) DEVELOPING ROLLER, DEVELOPING DEVICE, AND IMAGE FORMING APPARATUS INCLUDING DEVELOPING DEVICE

(71) Applicant: KYOCERA Document Solutions Inc., Osaka-shi, Osaka (JP)

(72) Inventors: Tamotsu Shimizu, Osaka (JP); Yuji Kamiyama, Osaka (JP); Akihiro Watanabe, Osaka (JP); Yoshinobu Yoneima, Osaka (JP); Shizuka Okada, Osaka (JP); Sakae Saito, Osaka (JP); Yasuhiro Oishi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/572,642

(22) Filed: Dec. 16, 2014

(65) Prior Publication Data

US 2015/0177644 A1 Jun. 25, 2015

(30) Foreign Application Priority Data

Dec. 20, 2013 (JP) ..... 2013-264426

(51) Int. Cl.
*G03G 15/09* (2006.01)
*G03G 15/08* (2006.01)

(52) U.S. Cl.
CPC ..... *G03G 15/0808* (2013.01); *G03G 15/09* (2013.01)

(58) Field of Classification Search
CPC ..... G03G 15/09; G03G 15/0808
USPC ..... 399/276
See application file for complete search history.

(56) References Cited

FOREIGN PATENT DOCUMENTS

JP 2009251272 A 10/2009

*Primary Examiner* — David Bolduc
*Assistant Examiner* — Barnabas Fekete
(74) *Attorney, Agent, or Firm* — Alleman Hall McCoy Russell & Tuttle LLP

(57) ABSTRACT

A developing roller includes a roller main body disposed to face, without contact, an outer circumferential surface of an image carrier. The roller main body includes a resin coat layer that is formed on an outer circumferential surface of a base body that is made of a metal including aluminum, the resin coat layer being made of a resin material and having electric conductivity. An AC impedance Z obtained from an application of an AC voltage at a frequency in a range from 0.05 Hz to 100 Hz is equal to or higher than 100Ω, and a phase angle θ satisfies a relationship of 0 rad<θ<0.1 rad when a power factor is cos θ=Za/Z.

7 Claims, 6 Drawing Sheets

FIG. 5

| | TYPE OF RESIN COAT LAYER | FREQUENCY (Hz) | 1000 | 100 | 10 | 1 | 0.1 | 0.01 | LEAK | DEVELOP ABILITY |
|---|---|---|---|---|---|---|---|---|---|---|
| EX1 | NYLON COAT (100 pts.wt., 5 μm) | Z(Ω) | 1200 | 1160 | 1110 | 0.002 | 0.009 | 0.0135 | ○ | ○ |
| | | θ(rad) | 0.019 | 0.003 | 8E−04 | 1130 | 1200 | 1200.1 | | |
| EX2 | NYLON COAT (100 pts.wt., 8 μm) | Z(Ω) | 4987 | 4760 | 4188 | 4200 | 4590 | 4589.5 | ○ | ○ |
| | | θ(rad) | 0.081 | 0.009 | 0.001 | 0.003 | 0.008 | 0.0144 | | |
| EX3 | LOWER LAYER: NYLON COAT (0 pts.wt., 2 μm) UPPER LAYER: NYLON COAT (100 pts.wt., 6 μm) | Z(Ω) | 31511 | 32348 | 30440 | 29810 | 33212 | 33294 | ○ | ○ |
| | | θ(rad) | 0.405 | 0.044 | 0.005 | 0.002 | 0.01 | 0.0159 | | |
| CF1 | URETHANE COAT | Z(Ω) | 1E+05 | 1E+06 | 4E+06 | 4E+06 | 5E+06 | 4E+06 | ○ | × |
| | | θ(rad) | 1.327 | 1.195 | 0.485 | 0.099 | 0.037 | 0.0213 | | |
| CF2 | URETHANE COAT | Z(Ω) | 4127 | 12208 | 36363 | 1E+05 | 6E+05 | 2E+06 | ○ | × |
| | | θ(rad) | 0.815 | 0.693 | 0.798 | 0.966 | 0.96 | 0.6174 | | |
| CF3 | URETHANE COAT | Z(Ω) | 0.579 | 0.644 | 0.634 | 0.709 | 0.707 | 0.7049 | × | ○ |
| | | θ(rad) | 0.006 | 6E−04 | 1E−04 | 3E−04 | 3E−04 | 0.0001 | | |
| CF4 | PHENOL RESIN COAT | Z(Ω) | 0.317 | 0.193 | 0.163 | 0.128 | 0.102 | 0.0916 | × | ○ |
| | | θ(rad) | 0.016 | 0.004 | 7E−04 | 2E−04 | 0.003 | 0.0027 | | |
| CF5 | PHENOL RESIN COAT | Z(Ω) | 7.25 | 6.89 | 7.23 | 4.42 | 4 | 4.2499 | × | ○ |
| | | θ(rad) | 5E−04 | 7E−04 | 7E−04 | 0.007 | 0.003 | 0.0074 | | |

DEVELOPING ROLLER, DEVELOPING DEVICE, AND IMAGE FORMING APPARATUS INCLUDING DEVELOPING DEVICE

INCORPORATION BY REFERENCE

This application is based upon and claims the benefit of priority from the corresponding Japanese Patent Application No. 2013-264426 filed on Dec. 20, 2013, the entire contents of which are incorporated herein by reference.

BACKGROUND

The present disclosure relates to a technology of a developing roller that is disposed to face, without contact, the outer circumferential surface of the image carrier.

A developing device is installed in an image forming apparatus which is a copier, a printer or the like and forms an image on a paper sheet based on the electrophotography. The developing device develops, by toner, an electrostatic latent image formed on an image carrier such as a photoconductor drum. As the developing method, a so-called two-component developing method is known which uses two-component developer including magnetic carrier and toner to develop a toner image on the image carrier. As an example of the two-component developing method, there is conventionally known a contactless developing system called "interactive touchdown developing system". In the interactive touchdown developing system, a developing roller and a magnetic roller are used. The developing roller is disposed at a predetermined distance from the image carrier. A magnet is embedded in the magnetic roller. The magnetic roller draws up the magnetic carrier as well as the toner, and holds them on the surface thereof. The magnetic roller forms a magnetic brush thereon to transfer only the toner to the developing roller, and form a toner thin layer on the developing roller. An AC electric field is generated by a developing bias that includes an AC component applied to the developing roller, and the AC electric field flies the toner from the developing roller and causes the toner to adhere to the electrostatic latent image on the image carrier.

There is known a developing roller used in this type of developing device, wherein in the developing roller, a base body made of aluminum is coated with an alumite layer, and the alumite layer is coated with a resin coat layer. The alumite layer plays a role in suppressing a leak from occurring between the image carrier and the developing roller.

The alumite layer of the developing roller is an aluminum oxide coating film formed on the surface of the base body by an electrochemical treatment (called "alumite treatment" or "anodic oxidation processing") where the base body of aluminum, as a positive electrode, is dipped into an electrolytic tank containing acidic aqueous solution, and a current is supplied thereto. During the process of forming the resin coat layer on the surface of the alumite layer, the developing roller is subjected to a high-temperature environment (for example, from 90° C. to 130° C.) to dry the resin coat layer. Alumite is easy to generate cracks when it is laid in a high-temperature environment, due to a difference in thermal expansion coefficient from aluminum, which is a raw material of alumite. When cracks occur during the drying process of the resin coat layer, resin enters the cracks. This causes the resistance value of the developing roller to change, and the insulation performance of the developing roller changes. The cracks are different in number and size for each developing roller. Thus, the amount of resin that has entered the cracks of the alumite layer is different in each developing roller, and as a result, the insulation performance varies for each developing roller. The cracks are present deep in the alumite layer and the tips of the cracks function as electrodes. This becomes a cause to break the insulation of the alumite layer and generate a leak. On the other hand, there has been conventionally known a configuration for suppressing variation in performance of the developing roller, wherein the resin coat layer is directly formed on the base body of the developing roller, without forming the alumite layer on the base body.

SUMMARY

A developing roller according to an aspect of the present disclosure includes a roller main body disposed to face, without contact, an outer circumferential surface of an image carrier. The roller main body includes a resin coat layer that is formed on an outer circumferential surface of a base body that is made of a metal including aluminum, the resin coat layer being made of a resin material and having electric conductivity. An AC impedance Z obtained from an application of an AC voltage at a frequency in a range from 0.05 Hz to 100 Hz is equal to or higher than 100Ω, and a phase angle θ satisfies a relationship of 0 rad<θ<0.1 rad when a power factor is cos θ=Za/Z.

A developing device according to another aspect of the present disclosure includes the developing roller and a magnetic roller. The magnetic roller is configured to form a toner layer on a surface of the developing roller via a magnetic brush composed of toner and magnetic carrier.

An image forming apparatus according to a further aspect of the present disclosure includes the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 5 is a table showing comparative examples 1 to 5 and examples 1 to 3 pertaining to the developing sleeve.

DETAILED DESCRIPTION

The following describes embodiments of the present disclosure with reference to the drawings as appropriate. It should be noted that the following embodiments are only examples of specific embodiments of the present disclosure and can be varied as appropriate without changing the gist of the present disclosure.

Figure 1:
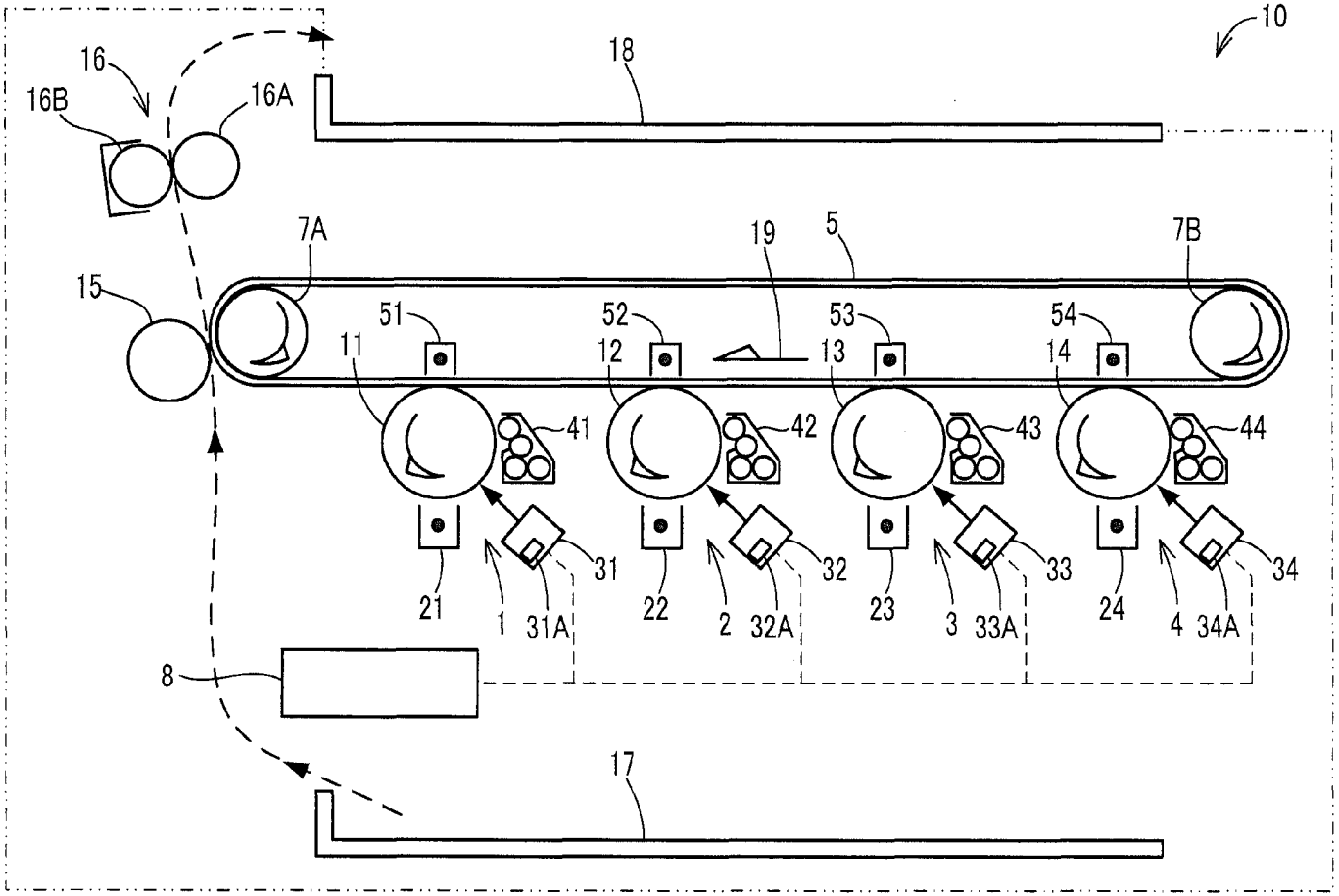
FIG. 1 is a schematic diagram showing the configuration of the image forming apparatus in an embodiment of the present disclosure.

FIG. 1 is a schematic diagram showing an outlined configuration of an image forming apparatus 10 (an example of the image forming apparatus of the present disclosure) in an embodiment of the present disclosure. As shown in FIG. 1, the image forming apparatus 10 is a so-called tandem color image forming apparatus, and includes a plurality of image forming portions 1-4, an intermediate transfer belt 5, a driving roller 7A, a driven roller 7B, a secondary transfer device 15, a fixing device 16, a control portion 8, a sheet feed tray 17, and a sheet discharge tray 18. It is noted that specific examples of the image forming apparatus 10 in an embodiment of the present disclosure are a copier, a facsimile, a printer that can form a color image or a monochrome image, and a multifunction peripheral having these functions.

The image forming portions 1-4 form images based on the electrophotography. The image forming portions 1-4 form toner images of different colors respectively on a plurality of photoconductor drums 11-14 arranged in an alignment (an example of the image carrier of the present disclosure), and transfer the toner images onto the intermediate transfer belt 5 in sequence while the intermediate transfer belt 5 is running (moving) so that the images are overlaid with each other. In an example shown in FIG. 1, in order from the downstream side in the movement direction (the direction indicated by arrow 19) of the intermediate transfer belt 5, an image forming portion 1 for black, an image forming portion 2 for yellow, an image forming portion 3 for cyan, and an image forming portion 4 for magenta are arranged in a row in the stated order.

The image forming portions 1-4 include the photoconductor drums 11-14, charging devices 21-24, exposure devices 31-34, developing devices 41-44 (an example of the developing device of the present disclosure), first transfer devices 51-54 and the like, respectively. The photoconductor drums 11-14 carry toner images on the surfaces thereof. The charging devices 21-24 charge the surfaces of the corresponding photoconductor drums 11-14 to a predetermined potential. The exposure devices 31-34 form electrostatic latent images on the charged surfaces of the photoconductor drums 11-14 by exposing the surfaces to light that is scanned thereon. The developing devices 41-44 develop the electrostatic latent images on the photoconductor drums 11-14 by toner. The first transfer devices 51-54 transfer the toner images from the rotating photoconductor drums 11-14 onto the intermediate transfer belt 5. It is noted that although not shown in FIG. 1, the image forming apparatuses 1-4 also include cleaning devices for removing remaining toner from the surfaces of the photoconductor drums 11-14.

The intermediate transfer belt 5 is, for example, a belt having a shape of an endless loop and is made of rubber, urethane or the like. The intermediate transfer belt 5 is supported by the driving roller 7A and the driven roller 7B so as to be driven and rotated. The driving roller 7A is located close to the fixing device 16 (on the left side in FIG. 1), and the driven roller 7B is located away from the fixing device 16 (on the right side in FIG. 1). The surface of the driving roller 7A is made of, for example, a material such as rubber, urethane or the like that increases friction force with the intermediate transfer belt 5. By being supported by the driving roller 7A and the driven roller 7B, the intermediate transfer belt 5 moves (runs), with its surface contacting with the surfaces of the photoconductor drums 11-14. When the intermediate transfer belt 5 passes between the photoconductor drums 11-14 and the first transfer devices 51-54, the toner images are transferred in sequence from the photoconductor drums 11-14 onto the surface of the intermediate transfer belt 5 so that the images are overlaid with each other.

The second transfer device 15 transfers the toner image from the intermediate transfer belt 5 to a print sheet conveyed from the paper feed tray 17. The print sheet with the transferred toner image thereon is conveyed to the fixing device 16 by a conveyance device (not shown). The fixing device 16 includes a heating roller 16A heated to a high temperature and a pressure roller 16B disposed to face the heating roller 16A. The print sheet conveyed to the fixing device 16 is conveyed while being nipped by the heating roller 16A and the pressure roller 16B. This allows the toner image to be fused and fixed to the print sheet. The print sheet is then ejected onto the ejected paper tray 18.

As described above, the image forming apparatus 10 forms a color toner image on the surface of the intermediate transfer belt 5 by causing the plurality of image forming portions 1-4 to transfer toner images of different colors onto the intermediate transfer belt 5 while the belt is running so that the toner images are overlaid with each other. The color toner image is transferred by the second transfer device 15 from the intermediate transfer belt 5 to a print sheet. With this operation, a color image is formed on the print sheet. Note that, as another embodiment, the intermediate transfer belt 5 may be used as a conveyance belt, and the toner images may be overlaid directly on a print sheet that is conveyed on the conveyance belt. Also, as a still another embodiment, an intermediate transfer member shaped like a roller may be used in place of the intermediate transfer belt 5.

The control portion 8 comprehensively controls the image forming apparatus 10. The control portion 8 includes a CPU, a ROM, a RAM, an EEPROM, a motor driver, and the like. The RAM is a volatile storage medium, and the EEPROM is a nonvolatile storage medium. The RAM and the EEPROM are used as temporary storage memories for the various types of processes executed by the CPU. The motor driver drives and controls motors (not shown) for various purposes based on control signals from the CPU.

Figure 2:
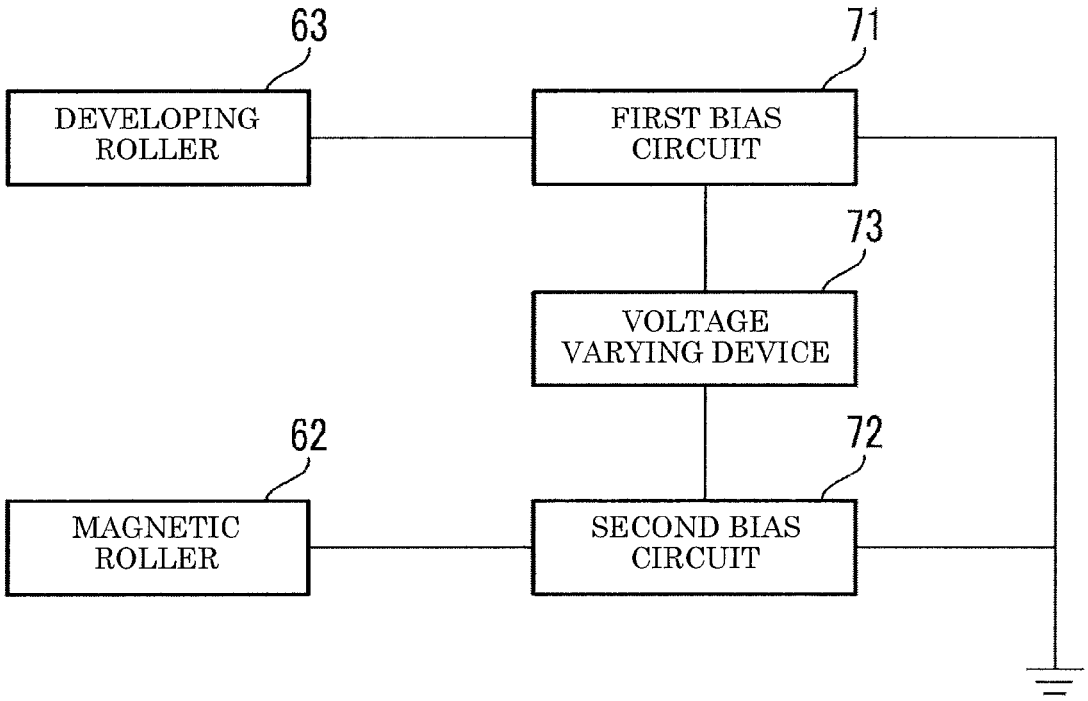
FIG. 2 is a block diagram showing the configuration of the control portion included in the image forming apparatus of FIG. 1.

As shown in FIG. 2, the control portion 8 includes a first bias circuit 71, a second bias circuit 72, and a voltage varying device 73. The first bias circuit 71 applies a voltage to a developing roller 63 which is included in each of the developing devices 41-44 (see FIG. 3). The second bias circuit 72 applies a voltage to a magnetic roller 62 which is included in each of the developing devices 41-44 (see FIG. 3). The voltage varying device 73 varies the voltages applied to the developing roller 63 and the magnetic roller 62.

Figure 3:
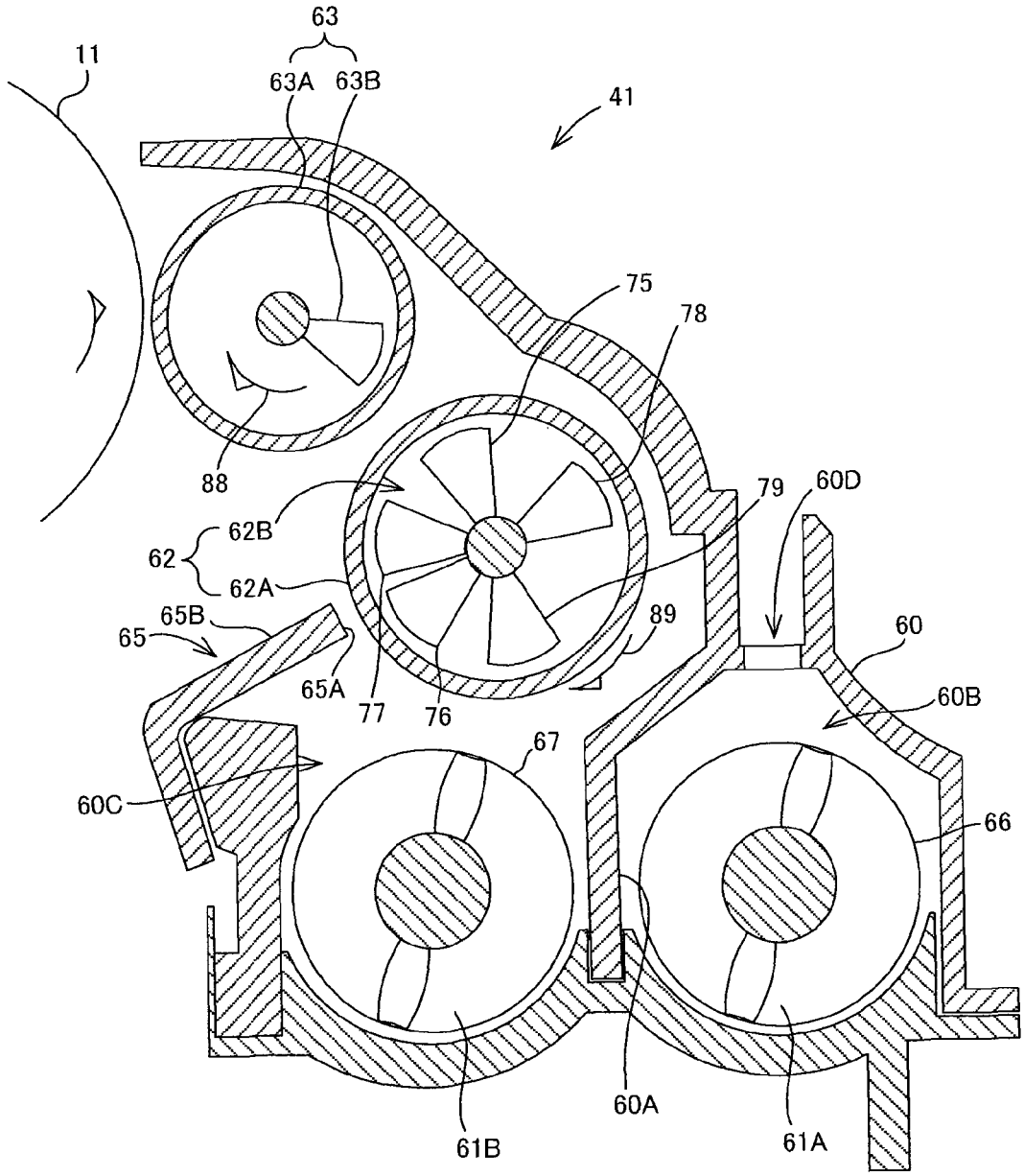
FIG. 3 is a cross sectional view showing the configuration of the developing device in an embodiment of the present disclosure.

FIG. 3 is a cross-sectional diagram showing the configuration of the developing device 41 included in the image forming portion 1. The following explains the configuration of the developing device 41 with reference to FIG. 3. It is noted that the other developing devices 42-44 have the same configuration as the developing device 41, and detailed description thereof is omitted.

The developing device 41 develops images by a developing system called "interactive touchdown developing system" which causes toner to be adhered to the electrostatic latent image while the developing device is not contacting the photoconductor drum 11. As shown in FIG. 3, the developing device 41 includes a developer case 60 in which two-component developer (hereinafter, may be merely referred to as "developer") including toner is stored. The developer container 60 is partitioned into a first stirring chamber 60B and a second stirring chamber 60C by a partition wall 60A. The developer is stored in both the first stirring chamber 60B and the second stirring chamber 60C. In the first stirring chamber 60B and the second stirring chamber 60C, the first stirring screw 61A and the second stirring screw 61B are rotatably provided, respectively. The toner is supplied from a toner container (not shown) to the developer case 60, and the first stirring screw 61A and the second stirring screw 61B mix the toner with magnetic carrier, stir them, and electrically charge the toner.

The magnetic roller 62 and the developing roller 63 (an example of the developing roller of the present disclosure) are provided in the developer container 60. The magnetic roller 62 holds, on its roller surface, the magnetic carrier adhered with the toner. The magnetic roller 62 forms a toner layer on the surface of the developing roller 63 via a magnetic brush, which, as described below, is composed of the magnetic carrier adhered with the toner. The developing roller 63 is disposed to face the magnetic roller 62. Specifically, the magnetic roller 62 is disposed above the second stirring screw 61B. The developing roller 63 is disposed at the upper left of the magnetic roller 62 to face the magnetic roller 62 with a predetermined gap therebetween. In addition, the developing roller 63 faces the photoconductor drum 11 at an opening 64 of the developer container 60 (at left in FIG. 3) with a predetermined gap therebetween. That is, the developing roller 63 is disposed to face the outer circumferential surface of the photoconductor drum 11. The magnetic roller 62 and the developing roller 63 are both rotated clockwise in FIG. 3 (see arrows 91, 92).

The magnetic roller 62 includes a non-magnetic rotating sleeve 62A and a magnetic-roller-side magnetic pole 62B that includes a plurality of magnetic poles. The rotating sleeve 62A is rotatably supported by a frame (not shown) of the developing device 41. The magnetic-roller-side magnetic pole 62B is contained in the rotating sleeve 62A. That is, the magnetic-roller-side magnetic pole 62B is provided inside the rotating sleeve 62A. The magnetic-roller-side magnetic pole 62B is fixed inside the rotating sleeve 62A. In the present embodiment, the magnetic-roller-side magnetic pole 62B has five magnetic poles: a main pole 75; a regulation pole (a brush-clipping magnetic pole) 76; a carrying pole 77; a peeling pole 78; and a draw-up pole 79. The magnetic poles 75-79 may be, for example, permanent magnets that generate magnetic forces.

The main pole 75 is attached to the magnetic-roller-side magnetic pole 62B in the state where the magnetic pole face of the main pole 75 faces the developing roller 63. The main pole 75 forms a magnetic field with a developing-roller-side magnetic pole 63B provided in the developing roller 63, wherein in the magnetic field, they pull each other.

The developer container 60 is provided with a brush-clipping blade 65. The brush-clipping blade 65 extends along a longitudinal direction of the magnetic roller 62 (namely in the direction perpendicular to the plane of FIG. 3). The brush-clipping blade 65 is disposed on the upstream side of a position at which the developing roller 63 faces the magnetic roller 62, in the rotational direction of the magnetic roller 62 (see the arrow 92). There is a small gap (a short distance) between the edge of the brush-clipping blade 65 and the roller surface of the magnetic roller 62.

The regulation pole 76 is attached to the magnetic-roller-side magnetic pole 62B in the state where the magnetic pole face of the regulation pole 76 faces the brush-clipping blade 65. That is, the regulation pole 76 and the brush-clipping blade 65 are disposed to face each other. The brush-clipping blade 65 is made of, for example, a non-magnetic material or a magnetic material. Since the brush-clipping blade 65 faces the regulation pole 76 of the magnetic-roller-side magnetic pole 62B, a magnetic field is generated in a gap between the top edge of the brush-clipping blade 65 and the rotating sleeve 62A, wherein in the magnetic field, the regulation pole 76 and the brush-clipping blade 65 pull each other. With the presence of this magnetic field, the magnetic brush, which is composed of the toner and the magnetic carrier, is formed between the brush-clipping blade 65 and the rotating sleeve 62A.

The developing roller 63 includes a cylindrical developing sleeve 63A (an example of the roller main body of the present disclosure) and the developing-roller-side magnetic pole 63B. The developing sleeve 63A is rotatably supported by a frame (not shown) of the developing device 41.

Figure 4B:
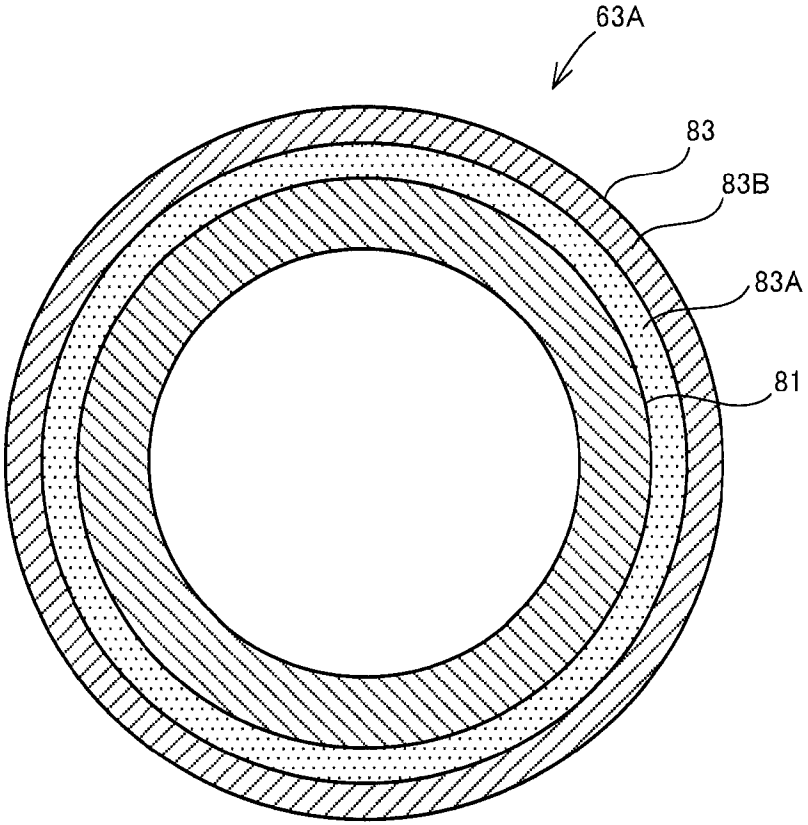
FIGS. 4A and 4B are cross sectional views showing the configuration of the developing sleeve of the developing roller included in the developing device.
Figure 4A:
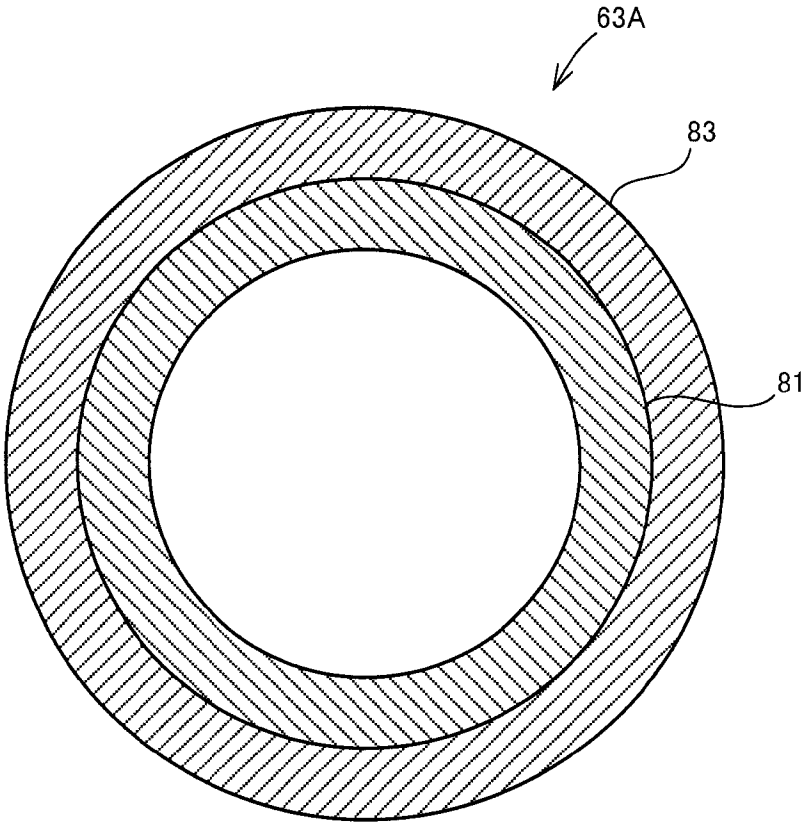

As shown in FIG. 4A, the developing sleeve 63A includes a cylindrical base body 81 which is a raw pipe made of aluminum, and the outer circumferential surface of the base body 81 is coated with a resin coat layer 83 (an example of the resin coat layer of the present disclosure) which is made of a resin material and has electric conductivity. That is, in the developing sleeve 63A, the resin coat layer 83 is directly formed on the outer circumferential surface of the base body 81, without forming an aluminum oxide coating film on the outer circumferential surface of the base body 81. Nylon resin is used as the material of the resin coat layer 83. That is, the resin coat layer 83 is a coat layer made of nylon resin. More specifically, the resin coat layer 83 is formed from nylon resin that includes titanium oxide in a dispersed state, wherein the titanium oxide has electric conductivity and is used as a conductive agent. The resin coat layer 83 has electric conductivity since it includes the titanium oxide.

In addition, as shown in FIG. 4B, the developing sleeve 63A is applicable to a two-layer resin coat layer. That is, the resin coat layer 83 formed on the outer circumferential surface of the base body 81 may be composed of a lower coat 83A made of only nylon resin, and an upper coat 83B made of nylon resin including the titanium oxide.

In the present embodiment, the resin coat layer 83 having a thickness in the range from 2 μm to 9 μm is formed on the surface of the base body 81 that is made of aluminum and 12 mm to 20 mm in outer diameter, by the dipping method. The material of the resin coat layer 83 is produced by adding 50 to 150 pts.wt. of titanium oxide to 100 pts.wt. of nylon resin.

The developing sleeve 63A of the present embodiment is manufactured through the following processes. That is, nylon resin as the binding resin, titanium oxide as the conductive agent, and 800 pts.wt. of methanol as the dispersion medium are mixed together with zirconia beads of 1.0 mm in diameter for approximately 48 hours by a ball mill. In the mixed liquid, the base body 81 made of aluminum is soaked and then taken out. The base body 81 is then dried in a high-temperature environment of 130° C. for 10 minutes. This completes manufacturing of the developing sleeve 63A that includes the base body 81 whose outer circumferential surface is coated with the resin coat layer 83 of 2 μm to 9 μm in thickness.

It is noted that when the resin coat layer 83 has the two-layer configuration and is composed of the lower coat 83A and the upper coat 83B, the resin coat layer 83 is formed as follows. That is, the base body 81 made of aluminum is soaked in the mixed liquid that includes titanium oxide, and then taken out and dried in a high-temperature environment of 130° C. Subsequently, the base body 81 is soaked in a mixed liquid including the nylon resin and the methanol (a mixed liquid not including a conductive agent), and then taken out and dried in the same manner. This completes manufacturing of the developing sleeve 63A on which the resin coat layer 83 of the two-layer configuration is coated. Here, when the resin coat layer 83 has the two-layer configuration and is composed of the lower coat 83A and the upper coat 83B, the resin coat layer 83 is formed such that the upper coat 83B is larger in thickness than the lower coat 83A, as in the example 3 of the developing sleeve 63A that is described below. This is because the lower coat 83A plays a role in preventing a leak from occurring and does not need to have a large thickness. In addition, since the surface of the upper coat 83B is exposed, the upper coat 83B needs to have a sufficient thickness to have durability against wear. In addition to these reasons, the lower coat 83A has a high impedance and the upper coat 83B has a low impedance. Accordingly, if the lower coat 83A is thicker than the upper coat 83B, the impedance of the whole resin coat layer 83 becomes too high. As a result, to suppress the impedance of the whole resin coat layer 83, the upper coat 83B is formed to have a larger thickness than the lower coat 83A.

As described above, the developing roller 63 is configured to have the developing sleeve 63A that does not include an aluminum oxide coating film. As a result, compared to conventional developing rollers that include the alumite layer, the developing roller 63 of the present disclosure can suppress variation in insulation performance, leak occurrence, and the like.

As shown in FIG. 3, the developing-roller-side magnetic pole 63B is included the developing sleeve 63A. That is, the developing-roller-side magnetic pole 63B is provided inside the developing sleeve 63A. The developing-roller-side magnetic pole 63B is composed of, for example, a permanent magnet that generates a magnetic force, and has a different polarity from the main pole 75. As a result, the developing-roller-side magnetic pole 63B and the main pole 75 form a magnetic field in which they pull each other.

A first bias circuit 71 (see FIG. 2) that applies a DC voltage (hereinafter referred to as "Vslv[DC]") and an AC voltage (hereinafter referred to as "Vslv[AC]"), is connected to the developing sleeve 63A of the developing roller 63. A second bias circuit 72 that applies a DC voltage (hereinafter referred to as "Vmag[DC]") and an AC voltage (hereinafter referred to as "Vmag[AC]"), is connected to the rotating sleeve 62A of the magnetic roller 62. The first bias circuit 71 and the second bias circuit 72 are grounded to the same ground. The first bias circuit 71 and the second bias circuit 72 superpose the DC voltage that is supplied from a DC power source (not shown), and the AC voltage that is supplied from an AC power source (not shown), and apply the superposed voltage.

A voltage varying device 73 (see FIG. 2) is connected to the first bias circuit 71 and the second bias circuit 72. The voltage varying device 73 can vary the Vslv[DC] and the Vslv[AC] to be applied to the developing roller 63, and vary the Vmag [DC] and the Vmag[AC] to be applied to the magnetic roller 62.

As described above, the developer is stirred by the first stirring screw 61A and the second stirring screw 61B while being circulated in the developer container 60, wherein the toner is charged and the developer is conveyed to the magnetic roller 62 by the second stirring screw 61B. The brush-clipping blade 65 is disposed to face the regulation pole 76 of the magnetic-roller-side magnetic pole 62B. As a result, the magnetic brush is formed between the brush-clipping blade 65 and the rotating sleeve 62A. The magnetic brush on the magnetic roller 62 is regulated in layer thickness by the brush-clipping blade 65, and as the rotating sleeve 62A rotates, the magnetic brush moves to a position at which it faces the developing roller 63. At this position, a magnetic field is imparted to the magnetic brush, wherein in this magnetic field, the main pole 75 of the magnetic-roller-side magnetic pole 62B and the developing-roller-side magnetic pole 63B pull each other. This causes the magnetic brush to be contacted with the roller surface of the developing roller 63. As a result, the toner having been adhered to the magnetic carrier of the magnetic brush is transferred to the developing roller 63. In addition, due to a potential difference ΔV between Vmag[DC] applied to the magnetic roller 62 and Vslv[DC] applied to the developing roller 63, a toner thin layer is formed on the roller surface of the developing roller 63. It is noted that the toner thin layer on the developing roller 63 varies in thickness as the potential difference ΔV is adjusted by the voltage varying device 73.

As the developing roller 63 rotates, the toner thin layer formed on the developing roller 63 via the magnetic brush is conveyed to a position where the photoconductor drum 11 and the developing roller 63 face each other. Since a voltage including an AC component has been applied to the developing sleeve 63A of the developing roller 63, toner flies toward the photoconductor drum 11 due to the potential difference (developing bias) between the developing roller 63 and the photoconductor drum 11. At this time, the toner reciprocates actively between the photoconductor drum 11 and the developing sleeve 63A due to an AC electric field formed by the AC voltage applied to the developing sleeve 63A. Toner that has reached the electrostatic latent image on the photoconductor drum 11 adheres to and develops the electrostatic latent image. On the other hand, toner reciprocating between the developing sleeve 63A and a non-image area other than the electrostatic latent image is returned to the developing sleeve 63A without adhering to the non-image area.

When the rotating sleeve 62A of the magnetic roller 62 further rotates clockwise, the magnetic brush is separated from the roller surface of the developing roller 63 due to a magnetic field in a horizontal direction (a circumferential direction of the roller) that is generated by the carrying pole 77 that is adjacent to the main pole 75 and has a different pole. As a result, toner that has remained without being used in the developing is collected from the developing roller 63 onto the rotating sleeve 62A. When the rotating sleeve 62A further rotates, a magnetic field is imparted, wherein in the magnetic field, the peeling pole 78 and the draw-up pole 79 of the magnetic-roller-side magnetic pole 62B, both having the same polarity, repel each other. This causes the toner to be separated from the rotating sleeve 62A in the developer container 60. The toner and the magnetic carrier are then stirred and conveyed by the second stirring screw 61B, drawn up again by the draw-up pole 79 and held on the rotating sleeve 62A as a two-component developer that has appropriate toner density and has been uniformly charged. The magnetic brush is then formed and conveyed to the brush-clipping blade 65.

Meanwhile, the developing device 41 is required to have a good developability of the toner to develop the electrostatic latent image on the photoconductor drum 11. The developability of the developing device 41 has, to some extent, a proportional relationship with the volume resistance value of the developing sleeve 63A. As a result, it is possible to provide the developing device 41 with a good developability by obtaining a volume resistance value that ensures a good developability, and manufacturing the developing roller 63 to have the obtained volume resistance value. With the configuration of the present embodiment in which the resin coat layer 83 is directly formed on the surface of the base body 81 of the developing sleeve 63A, the variation in insulation performance and the occurrence of a leak due to cracks generated in conventional alumite layer are suppressed. However, there was a concern about a decrease in the developability of the developing sleeve 63A that consists only of the base body 81 and the resin coat layer 83. Suppose that the base body 81 is a resistance and the resin coat layer 83 is a capacitor, then when a developing bias is applied to the developing roller 63, charges may be accumulated on the surface of the resin coat layer 83, the developability may be decreased under the influence of the charges, and the image density at the image formation may be decreased. That is, the charges accumulated on the surface of the resin coat layer 83 that acts as the capacitor are the cause of the decrease in the developability. In that case, use of only the volume resistance value is not enough to obtain a satisfactory level of good developability.

In view of these, the inventors paid attention to properties where, when an AC voltage is applied to a dielectric or the like and the AC impedance of the dielectric is measured, an AC impedance obtained from the application of an AC voltage at a high frequency (for example, a frequency of equal to or higher than 1,000 Hz) indicates a volume resistance of the inside of the dielectric, and an AC impedance obtained from the application of an AC voltage at a low frequency (for example, a frequency of equal to or lower than 100 Hz) indicates an interface resistance (a surface resistance of the dielectric that acts as an electrode). Specifically, by regarding the developing sleeve 63A as the dielectric, AC voltages at different frequencies were applied to the developing sleeve 63A, and values of the AC impedance Z [Ω] were measured, and the measurement results were extensively studied. As a result, the inventors found that a resistance component Za and a capacitor reactance component Zb of an AC impedance Z obtained from an application of an AC voltage at a low frequency affect the developability, wherein the resistance component Za is the real part of the AC impedance Z, and the reactance component Zb is the imaginary part of the AC impedance Z. More specifically, the inventors found that a good developability is provided when the AC impedance Z obtained from an application of an AC voltage at a frequency in a range from 0.05 Hz to 100 Hz to the developing sleeve 63A is equal to or higher than 100Ω, and a phase angle θ satisfies a relationship of 0 rad<θ<0.1 rad when the power factor is cos θ=Za/Z.

The AC impedance Z indicates an electrical resistance observed when an AC voltage is supplied to the base body 81 of the developing sleeve 63A, and is represented by the following equation (1) using the resistance component Za and the reactance component Zb, wherein, in the equation, "f" denotes a frequency, and "Cs" denotes an electrostatic capacitance.

[Equation 1]

$$Z^2 = Za^2 + Zb^2 = Za^2 + \left(\frac{1}{2\pi f \cdot Cs}\right)^2 \quad (1)$$

Figure 6B:
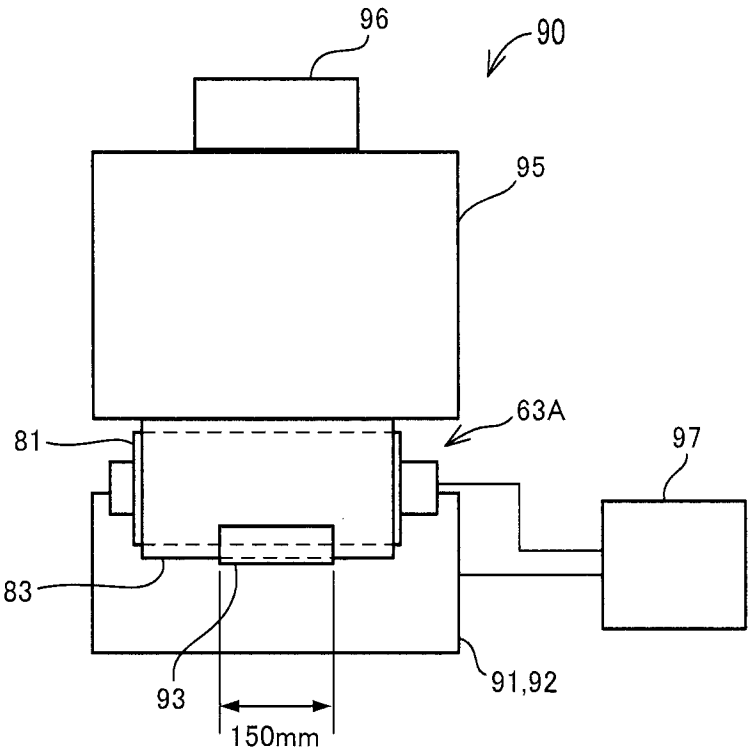
FIGS. 6A and 6B are diagrams showing an experimental device for measuring the AC impedance Z, resistance component Rs, and electrostatic capacitance component Cs of the developing sleeve.
Figure 6A:
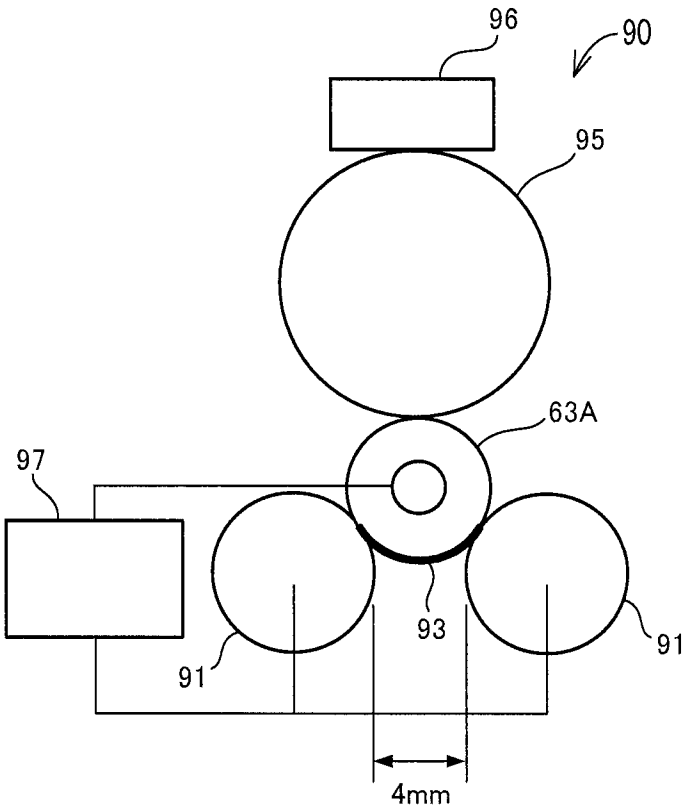

The following describes, with reference to FIGS. 5, 6A and 6B, the conditions that ensure a high developability of the developing sleeve 63A. FIG. 5 is a table showing comparative examples 1 to 5 and examples 1 to 3 pertaining to the developing sleeve 63A. Specifically, a plurality of types of developing sleeve 63A that differ in type of the resin coat layer (material of the resin coat layer, content of titanium oxide, and thickness of the resin coat layer) were prepared as the comparative examples and the examples. The AC impedance Z and the phase angle θ for power factor cos θ were then obtained for each of the comparative examples and the examples. Here, the resin coat layer 83 of the example 1 is a nylon coat having a thickness of 5 μm, made of a mixed resin material including 100 pts.wt. of titanium oxide to 100 pts.wt. of nylon resin. The resin coat layer 83 of the example 2 is a nylon coat having a thickness of 8 μm, made of a mixed resin material including 100 pts.wt. of titanium oxide to 100 pts.wt. of nylon resin. The resin coat layer 83 of the example 3 is a coat layer having the two-layer configuration, wherein the lower coat 83A is a nylon coat having a thickness of 2 μm and made of only nylon resin that does not include titanium oxide, and the upper coat 83B is a nylon coat having a thickness of 6 μm and made of a mixed resin material including 100 pts.wt. of titanium oxide to 100 pts.wt. of nylon resin. The comparative examples 1 to 3 are urethane coats that are different in thickness and content of titanium oxide. The comparative examples 4 and 5 are phenol resin coats that are different in thickness and content of titanium oxide.

FIGS. 6A and 6B are diagrams showing an experimental device 90 for measuring the AC impedances Z of the developing sleeve 63A and the resistance component Za. The experimental device 90 includes two SUS rollers 91, 92 which are made of stainless and each 18 mm in diameter and aligned in the horizontal direction with an interval of 4 mm therebetween. A film electrode 93 (150 mm long in the horizontal direction) made of aluminum is suspended between the SUS rollers 91 and 92. The developing sleeve 63A (comparative examples 1 to 5, examples 1 to 3) that is the target of the experiment is disposed such that the roller surface thereof is closely contacted with the upper surface of the film electrode 93. Furthermore, a SUS roller 95 of 30 mm in diameter is disposed above the developing sleeve 63A. A load is applied to the SUS roller 95 by a weight 96 of 500 g, and the load is applied to the developing sleeve 63A via the SUS roller 95. It is noted that the roller bodies including the developing sleeve 63A are subjected to the experiment in the state where they are not rotated. The two SUS rollers 91, 92 are connected to an electrode of an impedance measuring instrument 97 (LCR HiTESTER 3522 made by Hioki E.E. Corporation), and the base body 81 of the developing sleeve 63A is connected to the other electrode of the impedance measuring instrument 97. In this state, impedance is measured by the impedance measuring instrument 97. In this experiment, an AC voltage of sine wave and 5.0 V was applied to both ends of the impedance measuring instrument 97. The AC impedances Z of the developing sleeve 63A and the resistance component Za were then measured while varying the frequency of the applied AC voltage in the range from 1,000 Hz to 0.01 Hz. In the experiment, the measurement was performed a plurality of times (twice to 16 times), and the average values of the measured values are shown in the table of FIG. 5 as the experiment results.

Furthermore, from the results of forming monochrome images on print sheets by using the developing device 41 in which the developing sleeve 63A of each example shown in FIG. 5 has been installed, evaluation was made on the developability and the difficulty of leak occurrence (hereinafter referred to as "leak occurrence"). The respective evaluation results are shown in the table of FIG. 5. Here, with regard to the developability, after performing a three-sheet intermittent printing on 10,000 print sheets of A4 size by using a print pattern with the B/W ratio of 1%, the transmission density value was obtained from the output image, and the evaluation was made based on the transmission density value. In addition, with regard to the leak occurrence, after performing the printing continuously on 1,000 print sheets of A4 size by using a print pattern with the B/W ratio of 30%, the evaluation was made by visually observing all output images on the 1,000 print sheets. With regard to the developability, it was evaluated as ○ (Good) when the transmission density value was equal to or more than 1.0, Δ (Fair) when the transmission density value was equal to or more than 0.7 and less than 1.0, and x (Poor) when the transmission density value was less than 0.7. With regard to the leak occurrence, the output image was visually observed, and evaluated as ○ (Good) when no low-image-quality part affected by occurrence of leak was observed, and evaluated as x (Poor) when a low-image-quality part affected by occurrence of leak was observed.

It is noted that in evaluating the developability and the leak occurrence, the images were formed under the following conditions. As the specific conditions, the print speed was 30 sheets/minute, the circumferential speed of the photoconductor drum 11 was 180 mm/second, the distance between the photoconductor drum 11 and the developing sleeve 63A was 0.12 mm, the frequency of the AC voltage applied as the developing bias was 3.7 kHz, and the weight ratio of the toner and the carrier was 9%.

As shown in FIG. 5, among the comparative examples 1 to 5, no comparative example was evaluated as "good" in both the developability and the leak occurrence, and either the developability or the leak occurrence was evaluated as "poor". On the other hand, the examples 1 to 3 were evaluated as "good" in both the developability and the leak occurrence. As apparent from the table shown in FIG. 5, the developing sleeve 63A including the base body 81 coated with a coat layer made of nylon resin can suppress the occurrence of a leak. In addition, with regard to the developability, as apparent from comparison among the examples 1 to 3 and the comparative examples 1 to 5 in the values of the AC impedance Z and the phase angle θ when the power factor is cos θ, it is understood that a good developability is provided when the AC impedance Z obtained from an application of an AC voltage at a frequency in a range from 0.05 Hz to 100 Hz is equal to or higher than 100Ω, and a phase angle θ satisfies a relationship of 0 rad<θ<0.1 rad when the power factor is cos θ. This means that, in the developing roller 63 of the present embodiment, the AC impedance Z and the phase angle θ are effective as indexes for objectively evaluating the developability. As a result, by configuring the developing sleeve 63A such that the AC impedance Z and the phase angle θ are in the above-mentioned ranges, it is possible to realize the developing roller 63 in which both the developability and the leak occurrence are good, and the variation in insulation performance is suppressed.

In addition, as shown in the example 3 of FIG. 5, when the developing sleeve 63A has the two-layer configuration, the lower coat 83A does not include titanium oxide, and only the upper coat 83B includes titanium oxide. With this configuration, the lower coat 83A ensures an appropriate insulation performance, while the upper coat 83B imparts an appropriate toner adhesiveness to the surface of the developing roller 63.

According to the above-described embodiment, as an example, the magnetic brush is used to form the toner layer on the developing sleeve 63A of the developing device 41. However, not limited to such a toner forming method, the present disclosure is applicable to other toner forming methods. In addition, the above-described embodiment explains, as an example, the developing device 41 that performs the developing by using a two-component developer. However, the present disclosure is applicable to developing devices and developing rollers that use a one-component developer whose main component is toner.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing roller comprising:

a roller main body disposed to face, without contact, an outer circumferential surface of an image carrier, wherein the roller main body includes a resin coat layer that is formed on an outer circumferential surface of a base body that is made of a metal including aluminum, the resin coat layer being made of a resin material and having electric conductivity, and an AC impedance Z obtained from an application of an AC voltage at a frequency in a range from 0.05 Hz to 100 Hz is equal to or higher than 100Ω, and a phase angle θ satisfies a relationship of 0 rad<θ<0.1 rad when a power factor is cos θ=Za/Z.

2. The developing roller according to claim 1, wherein the resin coat layer is made of nylon resin that includes titanium oxide in a dispersed state.

3. The developing roller according to claim 1, wherein the resin coat layer includes at least two layers including a lower coat and an upper coat, the lower coat being on a side of the base body, the upper coat being positioned on an outer side than the lower coat and forming a surface of the roller main body, and the lower coat is made of nylon resin that does not include titanium oxide, and the upper coat is made of nylon resin that includes titanium oxide in a dispersed state.

4. The developing roller according to claim 3, wherein the upper coat is larger in thickness than the lower coat.

5. The developing roller according to claim 1, wherein an outer diameter of the roller main body is in a range from 12 mm to 20 mm.

6. A developing device comprising:

the developing roller according to claim 1; and a magnetic roller configured to form a toner layer on a surface of the developing roller via a magnetic brush composed of toner and magnetic carrier.

7. An image forming apparatus comprising the developing device according to claim 6.

* * * * *